US006166647A

United States Patent [19]

Wong

[11] Patent Number: 6,166,647

[45] Date of Patent: Dec. 26, 2000

[54] FIRE DETECTOR

[75] Inventor: Jacob Y. Wong, Goleta, Calif.

[73] Assignee: Jaesent Inc., Goleta, Calif.

[21] Appl. No.: 09/484,853

[22] Filed: Jan. 18, 2000

[51] Int. Cl.[7] ..... G08B 17/10

[52] U.S. Cl. ..... 340/628; 340/627; 340/629; 340/630; 340/632; 340/522

[58] Field of Search ..... 340/628, 627, 340/632, 629, 630, 522

[56] References Cited

U.S. PATENT DOCUMENTS

| | | | |
|---|---|---|---|
| 5,650,624 | 7/1997 | Wong | 250/338.5 |
| 5,691,704 | 11/1997 | Wong | 340/628 |
| 5,831,537 | 11/1998 | Marman | 340/628 |

*Primary Examiner*—Daniel J. Wu
*Assistant Examiner*—Hung Nguyen
*Attorney, Agent, or Firm*—Daniel C. McKown

[57] ABSTRACT

An improved fire detector is obtained by combining a conventional smoke particle sensor with a fire radicals odor sensor; the latter being an electronic nose tuned to respond to the presence of a family of radicals, produced by most fires, that is responsible for the odor associated with a fire. The conventional smoke particle sensor is prevented from producing an alarm signal unless the tuned electronic nose senses that the fire-produced radicals are increasing at a rate that exceeds a preset threshold rate. In another aspect of the invention, the smoke particle sensor is provided with a second, lower, threshold connected to a timer so that an alarm will be produced if the lower threshold is exceeded, without interruption, for a preset time. The improved fire detector, using the combined sensors, has greater sensitivity and a lower false alarm rate.

2 Claims, 4 Drawing Sheets

FIRE DETECTOR

BACKGROUND OF THE INVENTION

1. Field of the Invention

The present invention is in the field of early warning devices for fire detection and more particularly relates to a compact apparatus comprising a conventional smoke detector, preferably a photoelectric type, working in conjunction with a tuned odor detector to suppress false alarms and to detect more rapidly the onset of a fire.

2. The Prior Art

The fire detectors that are available commercially today fall into three basic classifications, namely flame sensing, temperature sensing, and smoke particle sensing. This classification is designed to respond to the three principal types of energy and matter characteristics of a fire environment: flame, heat and smoke. A fourth class of fire detectors was advanced almost a decade ago (U.S. Pat. No. 5,053,754), although still not yet commercially exploited today, which measures the concentration and the rate of change in the concentration of carbon dioxide gas, a principal byproduct of fire combustion, at the onset of a fire as a means for early and rapid detection of it.

The flame sensing detector is designed to respond to the optical radiant energy generated by the diffusion flame combustion process—the illumination intensity and the frequency of flame modulation. Two types of flame detectors are commonly in use: the ultraviolet detectors which operate beyond the visible wavelengths below 4,000 A, and the infrared detectors which operate in the wavelengths above 7,000 A. To prevent false signals from the many sources of ultraviolet, visible and infrared optical radiation present in most hazardous areas, the detectors are programmed to respond only to radiation with frequency modulation within the flicker frequency range for flame (5–30 Hz).

Flame detectors generally work well and seldom generate false alarms. However, they are relatively complex and expensive fire detectors which are not amenable to low-cost and mass-oriented usage. Instead they are mostly utilized in specialized high-value and unique protection areas such as aircraft flight simulators, aircraft hangers, nuclear reactor control rooms, etc.

Thermal detectors are designed to operate from thermal energy output—the heat—of a fire. This heat is dissipated throughout the area by laminar and turbulent convection flow. The latter is induced and regulated by the fire plume thermal column effect of rising heated air and gases above the fire surface. There are two basic types of thermal detectors: the fixed temperature type and the rate-of-rise detector type. The fixed temperature type further divides into the spot type and the line type. The spot detector involves a relatively small fixed unit with a heat-responsive element contained within the unit or spot location of the detector. With the line detector the thermal reactive element is located along a line consisting of thermal-sensitive wiring or tubing. Line detectors can cover a greater portion of the hazardous area than can spot detectors.

Fixed temperature thermal fire detectors rate high on reliability, stability and maintainability but low on sensitivity. In modern buildings with high air flow ventilation and air conditioning systems, placing the fixed temperature detector is a difficult engineering problem. Consequently, this type of thermal fire detector is not widely used outside of very specialized applications.

A rate-of-rise type thermal fire detector is usually installed where a relatively fast-burning fire is expected. The detector operates when the fire plume raises the air temperature within a chamber at a rate above a certain threshold of operation—usually 15° F. per minute. However, if a fire develops very slowly and the rate of temperature rise never exceeds the detector's threshold for operation, the detector may not sense the fire.

The newest type of thermal fire detector is called a rate-compensated detector which is sensitive to the rate of temperature rise as well as to a fixed temperature level which is designed into the detector's temperature rating. Even with this dual approach, the most critical problem for effective operation of thermal fire detectors is the proper placement of detectors relative to the hazardous area and the occupancy environment consequently, this type of fire detector is seldom found in everyday households.

By far the most popular fire detector in use in everyday life today is the smoke detector. Smoke detectors respond to the visible and invisible products of combustion. Visible products of combustion consist primarily of unconsumed carbon and carbon-rich particles; invisible products of combustion consist of solid particles smaller than approximately five (5) microns, various gases, and ions. All smoke detectors can be classified into two basic types: Photoelectric type which responds to visible products of combustion and ionization type which responds to both visible and invisible products of combustion.

The photoelectric type is further divided into 1) projected beam and 2) reflected beam. The projected beam type of smoke detectors generally consist of a series of sampling piping from the holds or other protected space on the ship to the photoelectric detector. The air sample is drawn into the piping system by an electric exhaust pump. The photoelectric detector is usually enclosed in a metal tube with the light source mounted at one end and the photoelectric cell at the other end. This type of detector is rather effective due to the length of the light beam. When the visible smoke is drawn into the tube, the light intensity of the beam received in the photoelectric cell is reduced because it is obscured by the smoke particles. The reduced level of light intensity causes an unbalanced condition in the electrical circuit to the photocell which activates the alarm. The projected beam or smoke obscuration detector is one of the most established types of smoke detectors. In addition to use on ships, these detectors are commonly used to protect high-value compartments or other storage areas, and to provide smoke detection for plenum areas and air ducts.

The reflected light beam smoke detector has the advantage of a very short light beam length, making it adaptable to incorporation in the spot type smoke detector. The projected beam smoke detector discussed earlier becomes more sensitive as the length of the light beam increases, and often a light beam of 5 or 10 feet long is required. However, the reflected light beam type of photoelectric smoke detector is designed to operate with a light beam only 2 or 3 inches in length. A reflected beam visible light smoke detector consists of a light source, a photoelectric cell mounted at right angles to the light source, and a light catcher mounted opposite to the light source.

Ionization type smoke detectors detect both the visible and invisible particle matter generated by the diffusion flame combustion. As indicated previously, visible particulate matter ranges from 4 to 5 microns in size, although smaller particles can be seen as a haze when present in a high mass density. The ionization detector operates most effectively on particles from 1.0 to 0.01 microns in size. There are two basic types of ionization detectors. The first type has a bipolar ionized sampling chamber which is the area formed between two electrodes. A radioactive alpha particle source is also located in this area. The oxygen and nitrogen molecules of air in the chamber are ionized by alpha particles from the radioactive source. The ionized pairs move towards the electrodes of the opposite signs when electrical voltage is applied, and a minute electrical current flow is established across the sample chamber. When combustion particles enter the chamber they attach themselves to the ions. Since the combustion particles have a greater mass, the mobility of the ions now decreases, leading to a reduction of electrical current flow across the sampling chamber. This reduction in electrical current flow initiates the detector alarm.

The second type of ionization smoke detector has a unipolar ionized sample chamber instead of a bipolar one. The only difference between the two types is the location of the area inside the sample chamber that is exposed to the alpha source. In the case of the bipolar type the entire chamber is exposed leading to both positive and negative ions (hence the name bipolar). In the case of the unipolar type only the immediate area adjacent to the positive electrode (anode) is exposed to the alpha source. This results in only one predominant type of ions (negative ions) in the electrical current flow between the electrodes (hence the name unipolar).

Although unipolar and bipolar sampling chambers use different principles of detector design they both operate by the combustion products creating a reduced current flow and thus activating the detector alarm. In general the unipolar design is superior in giving the ionization smoke detectors a greater level of sensitivity and stability, with fewer fluctuations of current flow to cause false signals from variations in temperature, pressure and humidity. Most ionization smoke detectors available commercially today are of the unipolar type.

For the past three decades the ionization smoke detectors have dominated the fire detector market. One of the reasons is that the other two classes of fire detectors, namely the flame sensing detectors and the thermal detectors are appreciably more complex and costlier than the ionization smoke detectors. They are therefore mainly used only in specialized high-value and unique protection areas. In recent years, because of their relatively high cost, even the photoelectric smoke detectors have fallen behind significantly in sales to the ionization type. The ionization types are generally less expensive, easier to use and can operate for a full year with just one 9-volt battery. Today over 90% of households that are equipped with fire detectors use the ionization type smoke detectors. Despite their low cost, relatively maintenance-free operation and wide acceptance by the buying public, the smoke detectors are not without problems and certainly far from being ideal. There are a number of significant drawbacks for the ionization type smoke detectors to operate successfully as early warning fire detectors. Most people do not complain about them simply because there are no better alternatives in their price range.

One of the biggest problems with ionization smoke detectors is their frequent false alarms. By the nature of its operational principle, any micron-size particulate matter other than the smoke from an actual fire can set off the alarm. Kitchen grease particles generated by a hot stove is one classic example. Over-zealous dusting of objects and/or furniture near the detector is another. Steam from a bath room after somebody had taken a bath and opening the bathroom door could also set off the smoke detector mounted in the hallway. Even the accumulation of dust around the smoke detector itself after a long and unattended period of time had elapsed could lead to a false alarm. Frequent false-alarms are not just a harmless nuisance; some people actually disarm their smoke detectors by temporarily removing the battery in order to escape from such annoying episodes. This latter situation could be outright dangerous especially when these people forget to rearm their smoke detectors.

Another significant drawback for the current ionization smoke detector is its relatively slow speed to alert people of a fire. There are several factors that contribute to this particular drawback. The first fact is the detector trigger threshold for smoke which directly affects its response time to the onset of a fire. No doubt a lower trigger threshold would mean a faster fire detector. However, it also means more frequent annoying false alarms for the user. The second factor is the particular placement of the detector with respect to the spot where fire breaks out. Unlike ordinary gases, smoke is actually a complex sooty molecular cluster that consists mostly of carbon. It is much heavier than air and thus diffuses much slower than the gases encountered everyday. Therefore, if the detector happens to be at some distance from the location of the fire, it will be a while before enough smoke gets into the sampling chamber of the smoke detector to trigger the alarm. A third factor is the nature or type of fire itself. Although smoke usually accompanies fire, the amount produced can vary significantly depending upon the composition of the material that catches the fire. For example oxygenated fuels such as ethyl alcohol and acetone give less smoke than the hydrocarbons from which they are derived. Thus, under free-burning conditions oxygenated fuels such as wood and polymethyl methacrylate give substantially less smoke than hydrocarbon polymers such as polyethylene and polystyrene. As a matter of fact a small number of pure fuels namely carbon monoxide, formaldehyde, methaldehyde, formic acid and methyl alcohol burn with non-luminous flames and do not produce smoke at all.

Yet another drawback of present-day ionization smoke detectors has to do with contaminating our environment. Ionization type smoke detectors use a radioactive matter ($Co^{60}$) as the source for alpha particles. Although one can argue that the amount of radioactive material currently found in each ionization smoke detector is very small (probably only tens of milligrams) the number of units in operation however easily runs into tens of millions every year. Thus, the continued usage of this type of smoke detector does pose a serious long-term liability of building up a large amount of unwanted nuclear wastes. Since the half life of $Co^{60}$ is well over 1,000 years, the potential danger should not be ignored.

Finally, there are a number of lesser issues one has to deal with when using these low-cost ionization smoke detectors. These include the trouble and cost of having to replace its battery once every year or run the risk of owning a unit that does not work because of lack of power. Also, the presently available ionization smoke detectors are rarely equipped with a visual alarm which is desirable for hearing-impaired persons.

Recognizing the fact that effluent gases (most notably carbon dioxide, carbon monoxide and water vapor) invariably accompany a fire environment in addition to flame, heat and smoke, the present inventor in U.S. Pat. Nos. 5,053,754 (1991), 5,079,422 (1992) and 5,103,096 (1992) advanced the idea of measuring both the concentration and the rate of concentration changes for carbon dioxide gas in an enclosed space as a way to detect the onset of a fire. He reasoned that fire initiation is necessarily an oxidation process and carbon dioxide is invariably the principal byproduct of any oxidation along with water vapor. In addition to being generated abundantly right from the start of a fire, carbon dioxide is a very stable gas. Its concentration can easily be measured accurately using Non-Dispersive Infrared (NDIR) techniques that are very advanced at the present time. The average ambient $CO_2$ concentration level indoors of ~400–500 ppm (~0.04–0.05%) does not hinder the detection of additional fire-induced quantities as long as the carbon dioxide sensor designed as a fire detector has adequately fine sensitivity.

The advent of using carbon dioxide gas to help detect early onset of fires in early 1990's prompted a significant amount of fire detection research using this additional parameter in ensuing years leading up to today. So far the results can best be considered as mixed. There is very little doubt that $CO_2$ is a very useful parameter for early fire detection. However, the maximum $CO_2$ concentration detected during experiments with flaming fires are significantly greater than the maximum $CO_2$ detected during experiments with non-flaming fires (pyrolyzing fires, heated liquids and environmental odors). Based upon these experimental results, it is now generally believed that the $CO_2$ parameter is best deployed alongside with a conventional smoke detector (either ionization or photoelectric). This way almost 100% of false alarms, which have been a principal drawback for smoke detectors, could be avoided. Furthermore, the speed of response for such a dual fire detector system could be much faster than the smoke detector alone.

Despite these seemingly encouraging test results, such a dual $CO_2$/smoke fire detector has yet to make it to the marketplace. The reason for this is two-fold. First, the inclusion of the $CO_2$ parameter can only be achieved with a rather costly and sophisticated carbon dioxide sensor with relatively high sensitivity, long life and long-term stability. Unfortunately the added cost and complexity are not justified by the albeit much superior false-alarm resistant and speed of response performance characteristics for the mass market. Second, NDIR $CO_2$ sensors consume quite a bit of power by nature of its operation due to the need for a high temperature infrared source. Again, the extra power requirement for an added $CO_2$ parameter in the dual $CO_2$/smoke fire detector hinders its application in the commercial fire detector market which requires systems with many detectors wired together and with mandatory and adequate standby battery power. The fact that the $CO_2$/smoke dual fire detector consumes quite a bit more power than the stand-alone smoke detector and hence requires a very large standby battery power supply prevents its application even in the commercial marketplace today. Thus the need still persists today for a low-cost, radioactive-free, reliable and false alarm resistant fire detector for the public at large.

The introduction of the $CO_2$ parameter to assist the conventional smoke detector to eliminate false alarms and to provide faster response to the onset of fires as elucidated above represents a major step forward in the quest for the perfect fire detector. This progress was made based upon the observation that effluent gases, especially carbon dioxide gas, invariably accompany fire combustion in addition to the more familiar flame, heat and smoke. In addition to the work done on the $CO_2$ parameter to improve the general performance of fire detectors, other approaches have also been actively considered. The most notable one was the use of multiple sensors and neural network methodology to develop the so-called "intelligent" fire detector. Such an intelligent detector was achieved using the analysis of signature patterns for discriminating fire detection with multiple sensors. Such an array of multiple sensors include carbon dioxide gas sensor, carbon monoxide gas sensor, oxygen gas sensor, temperature sensor, smoke sensor and a so-called "Taguchi" tin oxide sensor which detects the presence of organic volatile compounds including strange odors. While the development of an intelligent fire detector is prudent and necessary in the long run, the complexity and high cost for such an intelligent fire detector is not amenable to mass applications in the marketplace.

Based upon the discussion presented above, it is clear that a rapid, reliable, low-cost, radioactive-free and maintenance-free fire detector would be a most welcome addition to the imperfect world of fire detectors.

SUMMARY OF THE INVENTION

A major purpose of the present invention is to provide a low-cost, low-power and reliable fire detector that is free from excessive false alarms and amenable to mass production filling the ultimate residential and commercial needs in the marketplace.

Another major purpose of the present invention is to introduce a totally new method of detecting early fires utilizing an added fire odor parameter, which is false-alarm resistant and faster for responding to fire initiation without exception.

The advent of fire detectors up to the present time has always been taking advantage of using the byproducts of fire such as flame, heat, smoke and effluent gases, notably carbon dioxide, carbon monoxide and water vapor, as a means for its detection. However, one byproduct of fire that has never been successfully utilized for its detection and early warning until the present invention is the odor or "smell" of a fire. There is virtually no argument that fire initiation and sustenance create a particular odor or "strange" smell that can easily be discerned by a normal nose.

There are two reasons why such a fire detection parameter had never been successfully exploited in the past. First, until very recently, no simple, specific, reliable, and low-cost odor sensors have been readily available in the public domain. Second, the odor of a fire is a strong function of its nature, dependent upon what materials are being burned or consumed in it. Thus without the advent of a fire odor detection methodology applicable to all types of fires, like the methodology disclosed in the present patent application, the use of an odor sensor for early fire detection will be largely ineffective, leading to possible and frequent episodes of false alarm that are totally unacceptable in a fire detector.

The research and development of odor sensors, particularly those emulating the human nose, have been ongoing for a number of years dating back to the early 1990's. Prior attempts to produce a human-nose-like sensor array have exploited heated metal oxide thin film resistors, polymer sorption layers on the surfaces of acoustic wave resonators, arrays of electrochemical detectors, or conductive polymers. Early and moderate successes include arrays of metal oxide thin film resistors, typically based on SnO films on ceramic substrates that have been coated with various catalysts, which yield distinct, diagnostic responses for several vapors. However, due to the lack of physical and analytical understanding of specific catalyst functions, SnO arrays do not allow deliberate chemical control of the response of elements in the arrays nor reproducibility of response from array to array. Surface acoustic wave resonators are extremely sensitive to both mass and acoustic impedance changes of the coatings in array elements, but the signal transduction mechanism involves somewhat complicated electronics, requiring very low frequency measurement down to 1 Hz while having to sustain a 100 MHz Rayleigh wave in the crystal. Attempts have also been made to construct sensors with conducting polymer elements that have been grown electrochemically through nominally identical polymer films and coatings without much success.

In the early 1990's, great progress was made on the development of a broadly responsive analyte detection sensor array utilizing a variety of "chemi-resistor" elements. Such a methodology can best be summarily described as the use of combinatorial polymer synthesis in the generation of a multi-sensor "chemi-resistor" array using pattern recognition neutral network as a means of achieving diverse analyte detection capability. More recent work on odor discrimination with an electronic nose, application of an electronic nose to the discrimination of coffees, an electronic nose for monitoring the flavor of beers and array-based vapor sensing using chemically sensitive, carbon black-polymer resistors were also reported, culminating in the summary work on "The Caltech electronic nose project" reported in 1996. Most recently, U.S. Pat. 5,891,398 issued Apr. 6, 1999 to Lewis et al. disclosed the latest invention on such an electronic nose using arrays of chemically sensitive polymer sensors with at least two sensors having different chemically sensitive resistors providing dissimilar differences in resistance. Such a broadly responsive analyte detection sensor array, based upon a variety of "chemi-resistors" elements, can be simply prepared and is readily modified chemically to respond to a broad range of analytes. In addition, these sensors yield a rapid, low power (because of very high device impedance), dc electrical signal in response to the fluid of interest, and their signals are readily integrated with software and hardware-based neural networks for purposes of analyte identification.

The present invention generally grew out of the teachings of the so-called electronic nose, as disclosed and taught by Lewis et al. in U.S. Pat. No. 5,891,398 (1999), to discriminate and sense the characteristic odor or smell of certain distinct yet common combustion byproducts of fire initiation as a means to generate an early alarm for a fire. It is logical to assume that apart from flame, heat, smoke and specific effluent gases other than those common ones mentioned earlier, the other byproducts of fire are a strong function of what materials are being burned or consumed in the ensuing fire. Some of these byproducts will be odorless but others will likely generate their own characteristic odor or smell. However, the use of the electronic nose disclosed in U.S. Pat. No. 5,891,398 (that responds to specific intensity thresholds for a wide range of odors) as an early warning fire detector will not be successful for two reasons. First, since we do not know a priori the nature and material contents of a fire, it would be very difficult to set the intensity threshold for the electronic nose for any specific group of odors for indicating the onset of a fire. A specific and universal fire odor methodology must first be developed to cope with this problem. Thus if a conventional electronic nose is used as a fire detector, it will be prone to frequent undesirable false alarms. Second, even though electronic nose sensor arrays can be fabricated today using advanced silicon-based integrated circuit (IC) and micro-fabrication (MEMS) techniques, including integration to other needed electronic constituents such as amplifiers, A/D converter, signal processor etc. as an all-contained micro-chip, the use of such a full-blown electronic nose as a fire detector will still be too complex and costly for mass applications, both in the residential and commercial arenas. A simpler and more specific fire odor sensor, designed based upon a developed fire odor methodology and which could be produced at a much low-cost, would be more desirable.

The present invention uses therefore a modified and selective electronic nose "tuned" only to detecting the odors of that particular group of fire byproducts that invariably accompany the onset and sustenance of a fire. In other words, this group of byproducts will always be part of the total byproducts of a fire irrespective of the nature of its material contents. Since the fire process is necessarily a chemical reaction taking place at high temperatures involving oxidation, most materials that can cause the onset and sustenance of a fire are hydrocarbon (HC) based and hence oxidizable by oxygen in the air. Thus the gas molecule species that are always present at a fire are carbon (C), hydrogen ($H_2$), oxygen ($O_2$) and nitrogen ($N_2$). The common byproducts of any fire, irrespective of its material contents, are the chemical radicals formed from these four basic molecular gas species when the temperature of the fire reaches a critical threshold for such decompositional reactions to take place spontaneously. Such common chemical radicals include those belonging to the formaldehyde ($CH_2O$) group which, although colorless, possess an irritating and pungent odor. Other radicals belonging to the acetic acid ($C_2H_4O_2$) group also possess a characteristic sour or vinegar-like pungent odor. Those belong to the nitrogen oxide group such as nitric oxide (NO), nitric acid ($HNO_3$) etc. also possess irritating and pungent odors. Thus it is this "pungent" odor produced by a mixtures of these chemical radicals (hereby designated as "fire radicals") derived from the high temperature induced decomposition of C, $H_2$, $O_2$ and $N_2$ molecular species as a result of a fire that the "tuned" electronic nose of the present invention will be trained to discriminate and detect.

The present invention combines a "tuned" electronic nose for detecting the characteristic "pungent" odor of all fires with a conventional smoke detector (photoelectric or ionization type) to form a low-cost, low power, reliable, false-alarm resistant and faster fire detector. The present invention uses a second fire detection parameter, namely the "pungent" odor of the ever present "fire radicals" of a fire, to augment cooperatively the obscuration parameter of the conventional smoke detector.

As alluded to earlier, a stand-alone smoke detector could suffer from frequent false alarms. This is especially the case for commercial fire detector systems set up in remote areas where frequent strong winds or sand storms exist. By adding the fire radicals odor parameter in accordance with the present invention, false alarms ordinarily caused by the smoke detector exceeding an obscuration threshold can be eliminated. This is because the threshold of the fire radicals odor must also be exceeded before this new fire detector can actually sound the fire alarm. Thus, this new combined fire detector is virtually false-alarm proof because the "tuned" electronic nose almost always works against a zero "pungent" fire radicals odor background. On the other hand, the so-called carbon dioxide parameter utilizing an NDIR gas sensor has to face a variable amount of carbon dioxide concentration background indoors, which depends upon occupancy and/or extenuating circumstances, such as a number of people smoking and opening soda pop cans at the same time inside an enclosed space.

Like the case for the effluent carbon dioxide gas from a fire, the fire radicals, either existing freely or more likely adsorbed on particulate matter (soot or unburned carbon) particles, are assisted by the heat convection flow generated by the hot fire to get rather quickly to the vicinity of the fire detector. Thus in essence, the smoke from a real fire will be the substance that generates not only the obscuration (by the smoke particles) factor, but also the "pungent" odor (from fire radicals adsorbed on the same smoke particles) factor for the presently invented fire detector. Since ordinary smoke (like kitchen grease) or particulate matter particles (like dust) do not carry the characteristic "pungent" odor due only to the fire radicals, the result (the present invention) is a fire detector that is extremely false alarm resistant. Furthermore, the presently invented fire detector could be rendered much faster than a conventional smoke detector because the obscuration threshold for the smoke detector can now be set lower than a stand-alone smoke detector as a result of the added fire odor sensor. Finally, with the advent of the so-called advanced silicon integrated circuits (IC) and micro-fabrication MEMS) technologies, the added simpler and more specific electronic nose used in the present invention can be manufactured in the form of a very low-cost, mass-produced small silicon chip. Thus the fire detector of the present invention, even with the added "tuned" electronic nose, is very competitive in cost with the conventional smoke detector.

A more detailed description of the fire detector of the present invention will be given below with the aid of accompanying drawings which are intended to illustrate a preferred embodiment of the invention. Clearly other embodiments are possible, and they are embraced within the scope of the invention.

DETAILED DESCRIPTION OF THE PREFERRED EMBODIMENT

Figure 1:
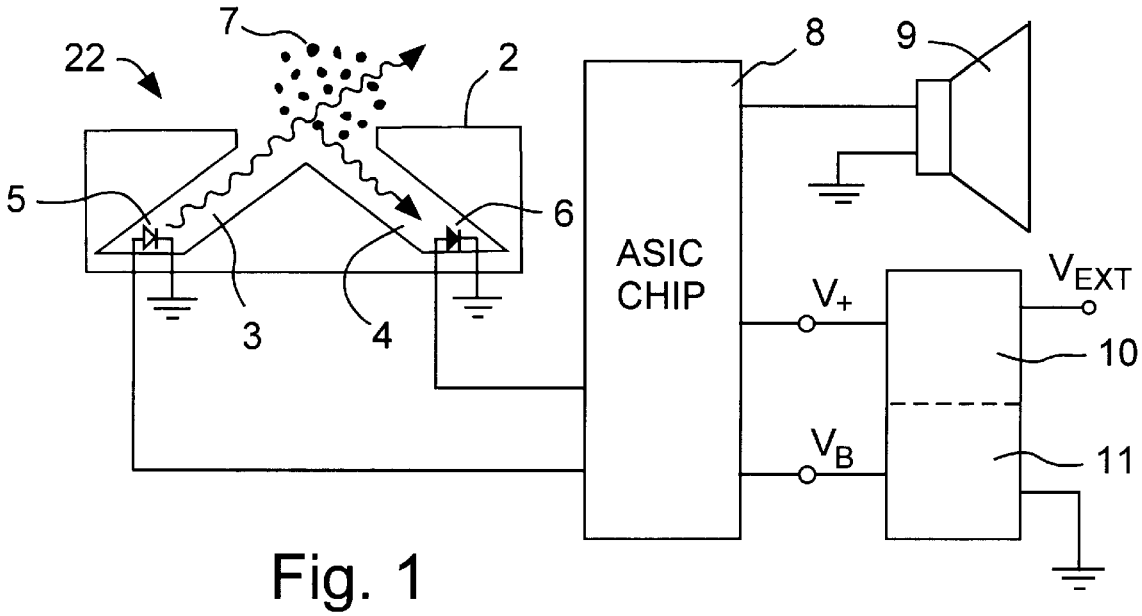
Fig. 1 (PRIOR ART)
FIG. 1 is a diagram of a prior art smoke detector of a photoelectric type.

FIG. 1 is a diagram showing a photoelectric smoke detector of a type known in the prior art. The sensor body 2 has two light channels 3 and 4 obliquely inclined to each other. Light emanating from a light emitting diode (LED) 5 propagates along channel 3 and normally will not reach the photodiode light detector 6 via channel 4. However, if thick smoke 7 gathers around the area where the two channels 3 and 4 meet, then light from the LED 5 will be scattered into channel 4 and eventually reaches the photodiode light detector 6. When this happens, the output of photodiode 6 will suddenly increase significantly above the background light intensity it normally receives from its surroundings. If the smoke continues to increase, as in the case of a fire, more scattered light will reach the photodiode 6 until its output exceeds a preset threshold and the smoke detector will sound the alarm announcing the onset or existence of a fire. The electronics needed to drive the LED 5 and to logically process the output from photodiode 6 is summarily represented by an Application Specific Integrated Circuit (ASIC) chip 8. ASIC chip 8 also drives the alarm warning loudspeaker 9 when the fire threshold condition is reached or exceeded. Power supply circuit 10 receives electrical voltage from an external source $V_{EXT}$ and provides the needed voltage $V_+$ to run the ASIC chip 8. A back-up battery supply 11 provides standby power for the smoke detector via $V_{BACKUP}$ in order to run the ASIC chip 8 when there is a general power failure.

Figure 2:
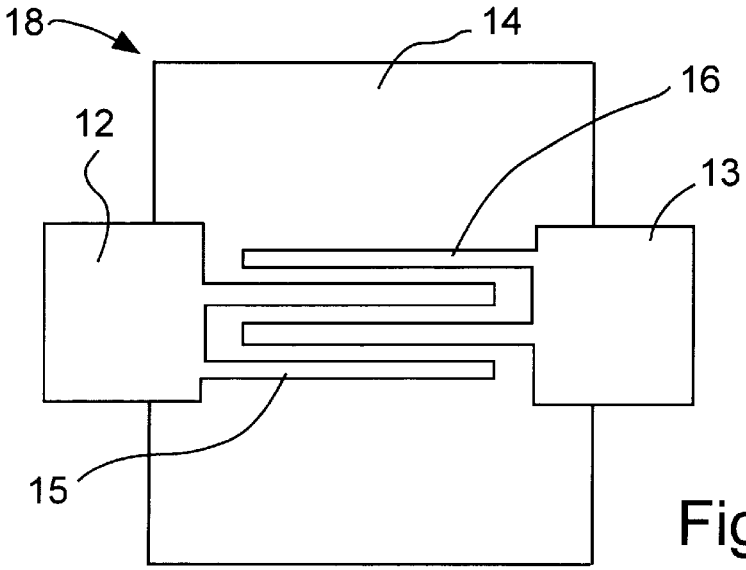
Fig. 2 (PRIOR ART)
FIG. 2 is a diagram of an individual prior art "chemi-resistor" sensor used in a fire radicals sensor array.

FIG. 2 is a diagram showing one of several individual "chemi-resistor" sensors forming a fire radicals sensor array as generally described and taught in U.S. Pat. No. 5,891,398. Such a "chemi-resistor" comprises first and second conductive elements (e.g., electrical leads), 12 and 13 respectively, electrically coupled to a chemically sensitive resistor 14 which provides an electrical path between the conductive elements 12 and 13. Both conductive elements 12 and 13 provide arrays of interdigitated electrodes, of which the electrodes 15 and 16 are typical, covering the chemically sensitive resistor 14 in order to achieve a more uniform electrical response from the sensor element 14. The chemically sensitive resistor 14 is fabricated by a special iterative selection of conducting polymers and plasticizers depending upon its chosen sensitivity to a particular analyte in fluid. One design approach, as disclosed in U.S. Pat. No. 5,891,398 is as follows. After a particular best-guessed and chosen synthesis of conducting polymers and plasticizers for a chemically sensitive resistor 14, for the detection of a particular analyte, the temporal response of this sensor (resistance versus time) to a known concentration of the analyte is recorded. The temporal response of this sensor can be normalized to a maximum percentage increase or decrease in resistance which produces a response pattern associated with exposure to known concentrations of the analyte. By iterative profiling of known analyte concentrations, a structure-function database correlating analytes and response profiles can be generated. Unknown analyte may then be characterized or identified using response pattern comparison and recognition algorithms.

Figure 3:
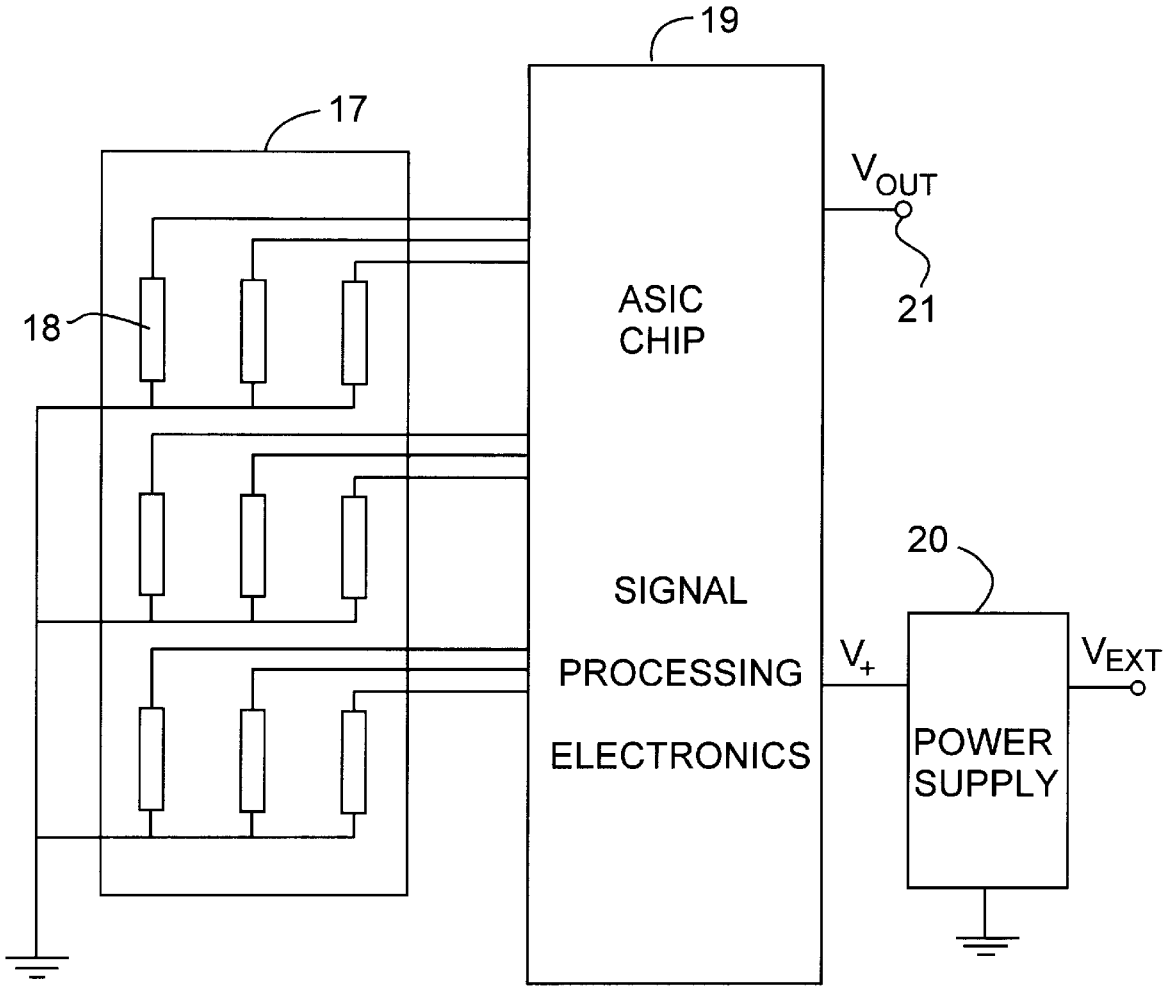
Fig. 3 (PRIOR ART)
FIG. 3 is a diagram of a fire radicals sensor array of the prior art comprising a number of individual "chemi-resistor" sensors and processing electronics.

FIG. 3 is a diagram showing a fire radicals sensor array 17 comprising N (here N=9 as illustrated) individual "chemi-resistor" elements, of which the element 18 shown in FIG. 2 is typical, associated signal processing electronics 19 and power supply unit 20 connected to external voltage supply $V_{EXT}$ and supplying voltage $V_+$ to electronic circuits 19. The fire radicals sensor array 17 is designed with the appropriately different conducting polymers and plasticizers to each of the nine "chemi-resistors" sensors in such a way that the characteristic "pungent" odor of the fire radicals can be singled out for quantitative detection without significant interference from other common household odors or otherwise. Thus it is possible to preset for sensor 17 a certain "pungent" odor concentration threshold indicative of the presence of a certain concentration ratio of fire radicals adsorbed to smoke particles due to the presence of a fire. When such a threshold is exceeded, an output $V_{OUT}$ will appear at terminal 21.

Figure 4:
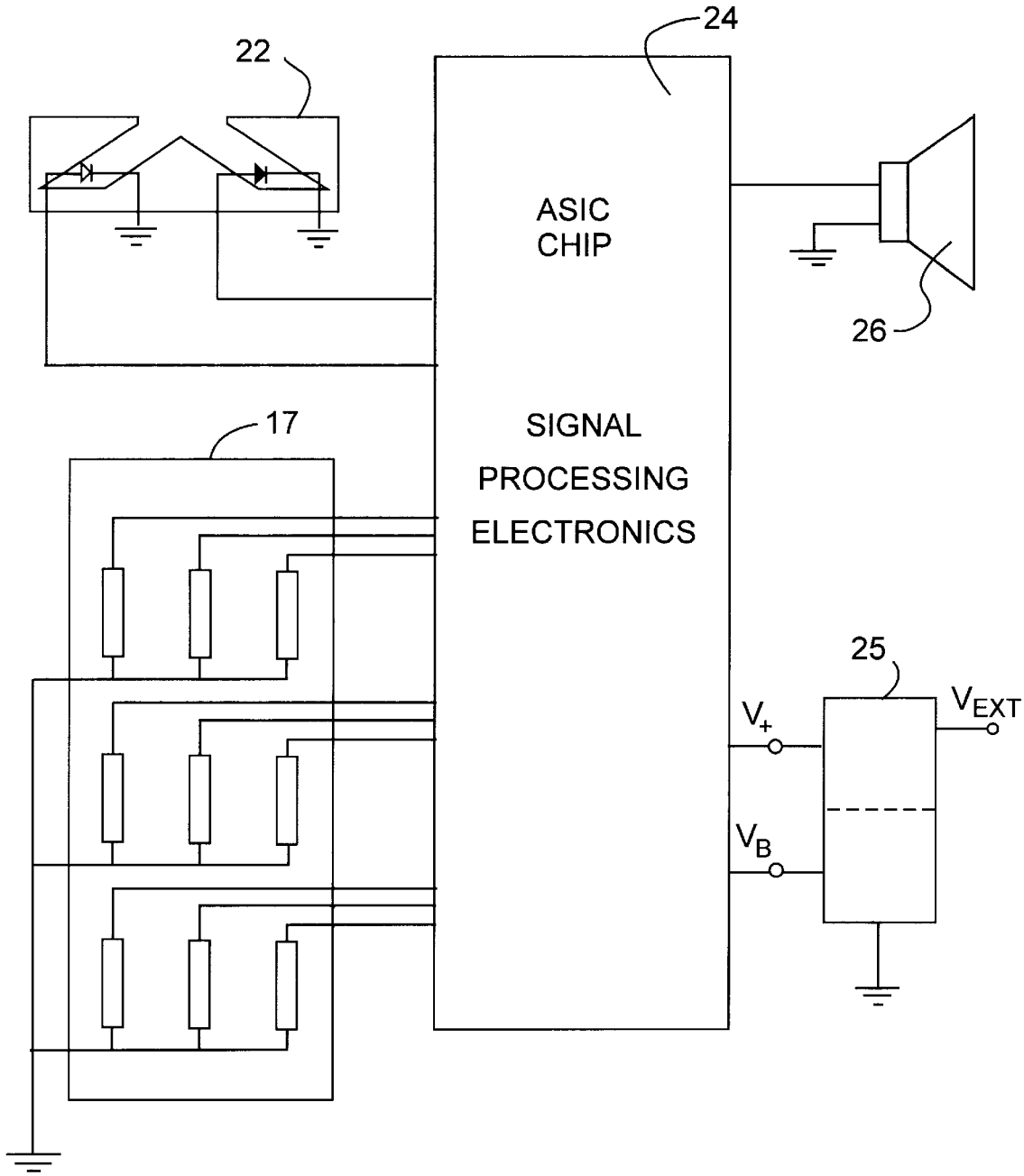
FIG. 4 is a diagram of the fire detector of the present invention which combines a conventional smoke defector and a tuned fire radicals sensor array; and, FIG. 5 is a logic diagram of a signal processor used in a preferred embodiment of the present invention.

FIG. 4 shows a preferred embodiment of the presently invented fire detector combining a conventional smoke detector (photoelectric type illustrated here) 22 and a fire radicals sensor array 17 with associated signal processing electronics 24, power supply unit 25 and alarm loudspeaker 26.

Figure 5:
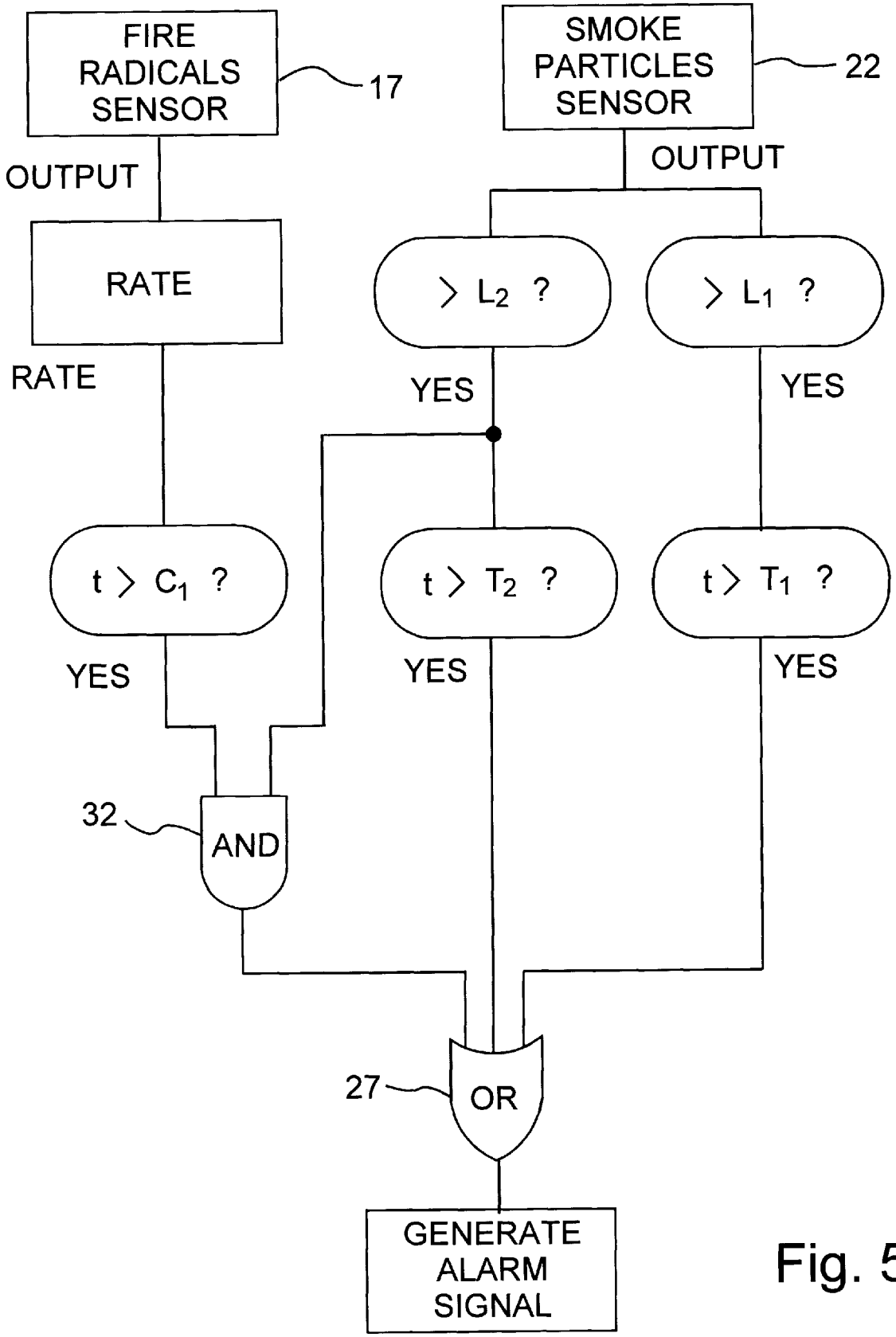

A flow diagram implementing the alarm logic for the signal processor 24 used in the preferred embodiment of the present invention is shown in FIG. 5. The exact components used to accomplish the logic functions as shown in FIG. 5 are not critical, nor are the pathways critical, as long as the same data will lead to the same results. Thus, for example, OR gate 27 could be replaced by multiple OR gates or other equivalent logic devices for accomplishing the same result. Accordingly, use of AND and OR gates is not meant to be restrictive and is done solely for ease of comprehension and illustration.

As illustrated in FIG. 5, in the preferred embodiment the fire detector generates an alarm signal when any of three conditions are met. First, an alarm signal will be generated if the output signal from smoke sensor 22 exceeds a threshold $L_1$ for greater than a first pre-selected time $T_1$ (e.g. 5 minutes). Second, an alarm signal will be generated if the output signal from the smoke sensor 22 exceeds a reduced threshold $L_2$ for greater than a second pre-selected time $T_2$ (e.g. 60 minutes). Third, an alarm signal will be generated through the positive output of AND gate 32 if the rate of increase in the concentration of the "pungent" class of odor exceeds a preset threshold $C_1$ rate and simultaneously light obscuration as measured by smoke sensor 22 exceeds the reduced threshold $L_2$. This third condition, when compared with the second condition, may be thought of as a dynamic adjustment to the smoke sensor fire detection criteria.

To minimize the response time of the fire detector of FIG. 5, the preferred embodiment uses a fire radicals sensor array to allow the fire detector to measure the rate of increase in the concentration of the "pungent" class of odor characteristic only of fire radicals from a fire. If the rate of increase exceeds a predetermined rate $C_1$ and the smoke sensor output signal indicates that light obscuration also exceeds a reduced threshold level $L_2$, an alarm signal is generated.

Thus, there has been described a new false-alarm resistant and faster fire detector than the commonly used smoke detector because its operation is related not only to smoke particles, but also to the "pungent" odor of smoke particles due to the adsorbed fire radicals as a direct result of a fire.

The foregoing detailed description is illustrative of one preferred embodiment of the invention, and it is to be understood that additional embodiments thereof will be obvious to those skilled in the art. The embodiment described herein together with those additional embodiments are considered to be within the scope of the invention.

What is claimed is:

1. A method for reducing false alarms in a fire detector of a type in which an alarm signal is generated when the output signal of a smoke sensor exceeds a preset threshold, said method comprising the steps of:

adding to the fire detector a fire radicals sensor that produces a fire radicals concentration signal;

determining the rate of change of the fire radicals concentration signal; and, inhibiting the alarm signal so long as the rate of increase of the fire radicals concentration signal remains below a preset threshold.

2. A fire detector for producing an alarm signal with a low false alarm rate, comprising:

a smoke sensor for producing an output signal responsive to the presence of smoke;

smoke threshold means connected to said smoke sensor for receiving the output signal of said smoke sensor and for producing an output signal when the output signal of said smoke sensor exceeds a preset level;

a fire radicals sensor for producing an output signal responsive to the presence of fire radicals;

rate means connected to said fire radicals sensor for receiving the output signal of said fire radicals sensor and for producing an output signal representative of the rate of change of the output signal of the fire radicals sensor;

fire radicals rate threshold means connected to said rate means for receiving the output signal of said rate means and for producing an output signal when the output signal of said rate means exceeds a preset level; and, logic means connected to said smoke threshold means and connected to said fire radicals rate threshold means, and producing an alarm signal only when both the output signal of said smoke threshold means and the output signal of said fire radicals rate threshold means are present simultaneously;

whereby, a low false alarm rate is achieved by inhibiting the smoke sensor from producing the alarm signal unless the fire radicals are increasing at a preset rate.

* * * * *